US009868294B2

(12) United States Patent
Hori

(10) Patent No.: US 9,868,294 B2
(45) Date of Patent: Jan. 16, 2018

(54) INKJET PRINTER

(71) Applicant: RISO KAGAKU CORPORATION, Tokyo (JP)

(72) Inventor: Eiji Hori, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/337,109

(22) Filed: Oct. 28, 2016

(65) Prior Publication Data

US 2017/0173970 A1 Jun. 22, 2017

(30) Foreign Application Priority Data

Dec. 17, 2015 (JP) ..... 2015-245887

(51) Int. Cl.
*B41J 2/175* (2006.01)
*B41J 2/18* (2006.01)

(52) U.S. Cl.
CPC ..... *B41J 2/17596* (2013.01); *B41J 2/175* (2013.01); *B41J 2/18* (2013.01)

(58) Field of Classification Search
CPC ..... B41J 2/17596; B41J 2/175; B41J 2/18
USPC ..... 347/85
See application file for complete search history.

(56) References Cited

U.S. PATENT DOCUMENTS

2007/0252860 A1* 11/2007 Nitta ..... B41J 2/175 347/14
2010/0214332 A1 8/2010 Iwase
2015/0097882 A1* 4/2015 Uchiyama ..... B41J 2/165 347/6

FOREIGN PATENT DOCUMENTS

| | | |
|---|---|---|
| EP | 2 540 508 | 1/2013 |
| JP | 2008-238125 | 10/2008 |
| JP | 2012-153004 | 8/2012 |

OTHER PUBLICATIONS

Extended European Search Report for EP 16198606.2 dated Feb. 27, 2017.

* cited by examiner

*Primary Examiner* — Huan Tran
*Assistant Examiner* — Alexander D Shenderov
(74) *Attorney, Agent, or Firm* — Greenblum & Bernstein, P.L.C.

(57) ABSTRACT

A controller of an inkjet printer performs control to: during ink delivery in a first ink tank pair, as a preparation of ink delivery in a second ink tank pair, generate positive pressure and negative pressure respectively in third and fourth ink tanks of the second ink tank pair and supply ink to the second ink tank pair; and upon completion of the ink delivery in the first ink tank pair, perform printing by ejecting the ink from an inkjet head while delivering the ink between the third and fourth ink tanks of the second ink tank pair prepared for the ink delivery via an ink flow passage and the inkjet head.

10 Claims, 8 Drawing Sheets

FLOW OF INK DELIVERED BETWEEN INK TANKS
FLOW OF AIR FOR PRESSURE GENERATION
FLOW OF SUPPLIED INK
CONTROLLER
PRESSURE SENSOR
PRESSURE SENSOR
SET AS POSITIVE PRESSURE TANK
SET AS NEGATIVE PRESSURE TANK (IN PREPARATION)
SET AS NEGATIVE PRESSURE TANK
SET AS POSITIVE PRESSURE TANK (IN PREPARATION)
1
2
3
4
5
11
12A
12B
12C
12D
13A
13B
13C
13D
14
15A
15B
15C
15D
16
17A
17B
17C
17D
18A
18B
18C
18D
20A
20B
21
22
23
24
26
27
28
29
31
32
33
34
35
36
37A
37B
37C
37D
38
39
40A
40B
40C
40D
41A
41B
41C
41D
42
43
46
47
48A
48B
48C
48D
51
52
53
54
55

INKJET PRINTER

CROSS REFERENCE TO RELATED APPLICATION

This application is based upon and claims the benefit of priority from the prior Japanese Patent Application No. 2015-245887, filed on Dec. 17, 2015, the entire contents of which are incorporated herein by reference.

BACKGROUND

1. Technical Field

The disclosure relates to an inkjet printer which performs printing by ejecting ink from an inkjet head.

2. Related Art

Japanese Unexamined Patent Application Publication No. 2012-153004 proposes an inkjet printer which performs printing by driving an inkjet head while circulating ink among a positive pressure tank upstream of the inkjet head, the inkjet head, and a negative pressure tank downstream of the inkjet.

In the inkjet printer, positive pressure and negative pressure are generated respectively in the positive pressure tank and the negative pressure tank. The ink is thereby delivered from the positive pressure tank to the negative pressure tank via the inkjet head. In the inkjet head, part of the ink delivered from the positive pressure tank is ejected. The ink is delivered from the negative pressure tank to the positive pressure tank by an ink pump. The ink circulation and the printing are thus performed.

SUMMARY

In the aforementioned inkjet printer including the ink pump, for example, when ink using pigment is used, parts of the ink pump may wear due to the ink and fail. Accordingly, types of usable inks are limited.

An object of the disclosure is to provide an inkjet printer which can relax the restriction on types of usable inks.

An inkjet printer in accordance with some embodiments includes: an inkjet head configured to eject ink; a first ink tank pair being a pair of a first ink tank and a second ink tank each configured to store the ink; a second ink tank pair being—a pair of a third ink tank and a fourth ink tank each configured to store—the ink; an ink flow passage connecting the inkjet head with the first to fourth ink tanks; a pressure generator configured to selectively generate positive pressure and negative pressure in the first to fourth ink tanks; an ink supplier configured to supply the ink to the first to fourth ink tanks; and a controller configured to control the inkjet head, the pressure generator, and the ink supplier. The controller is configured to: drive the pressure generator to generate positive pressure and negative pressure for ink delivery respectively in the first ink tank and the second ink tank of the first ink tank pair and perform printing by ejecting the ink from the inkjet head while delivering the ink between the first ink tank and the second ink tank of the first ink tank pair via the ink flow passage and the inkjet head; during the ink delivery in the first ink tank pair, as a preparation of ink delivery in the second ink tank pair, drive the pressure generator to generate positive pressure and negative pressure respectively in the third ink tank and the fourth ink tank of the second ink tank pair and drive the ink supplier to supply the ink to the second ink tank pair; and upon completion of the ink delivery in the first ink tank pair, perform printing by ejecting the ink from the inkjet head while delivering the ink between the third ink tank and the fourth ink tank of the second ink tank pair prepared for the ink delivery via the ink flow passage and the inkjet head.

In the configuration described above, it is possible to perform printing while continuously delivering the ink to the inkjet head in a configuration using no ink pump for delivering the ink between the ink tanks. Accordingly, for example, when ink including pigment is used, it is possible to avoid problems such as failures of parts of the ink pump due to wear of the parts caused by the ink. Hence, the restriction on types of usable inks can be relaxed.

The controller may be configured to: during the ink delivery in the second ink tank pair, as a preparation of ink delivery in the first ink tank pair, drive the pressure generator to generate positive pressure and negative pressure respectively in the first ink tank and the second ink tank of the first ink tank pair and drive the ink supplier to supply the ink to the first ink tank pair; and upon completion of the ink delivery in the second ink tank pair, perform printing by ejecting the ink from the inkjet head while delivering the ink between the first ink tank and the second ink tank of the first ink tank pair prepared for the ink delivery via the ink flow passage and the inkjet head.

DETAILED DESCRIPTION

Figure 1:
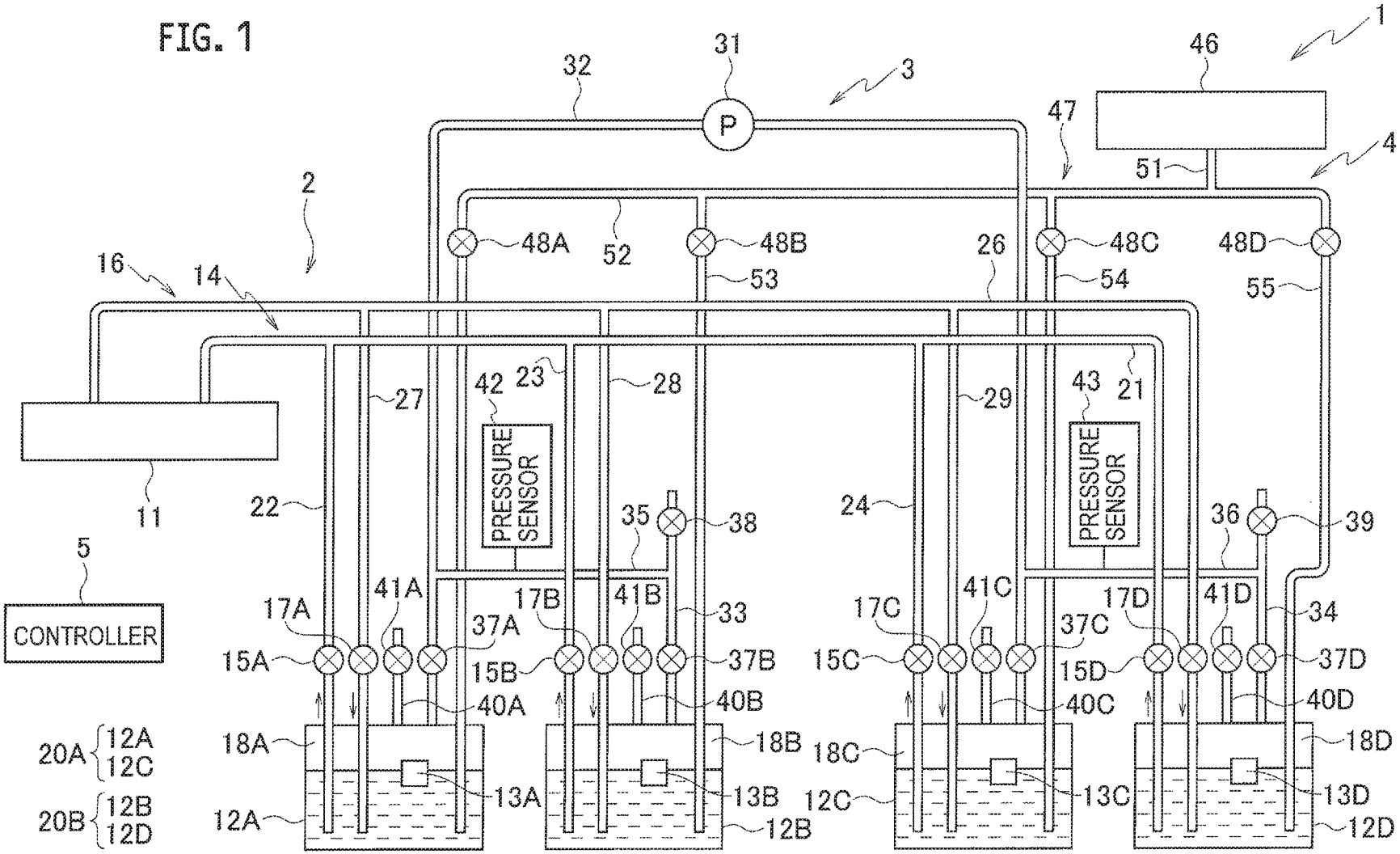
FIG. 1 is a schematic configuration diagram of an inkjet printer according to an embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for embodiments of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

FIG. 1 is a schematic configuration diagram of an inkjet printer 1 according to an embodiment of the present invention. As illustrated in FIG. 1, the inkjet printer 1 includes a printing unit 2, a pressure generator 3, an ink supplier 4, and a controller 5.

The printing unit. 2 prints an image on a sheet (not illustrated) by ejecting ink onto the sheet. The printing unit 2 includes an inkjet head 11, ink tanks 12A to 12D, liquid level sensors 13A to 13D, an ink outflow route 14, ink outflow valves 15A to 15D, an ink inflow route 16, and ink inflow valves 17A to 17D. Note that the ink outflow route 14 and the ink inflow route 16 correspond to an ink flow passage. Moreover, alphabets attached to the reference signs of the ink tanks 12A to 12D and the like are sometimes omitted to generally refer to the ink tanks 12A to 12D and the like.

The inkjet head 11 includes multiple nozzles (not illustrated) and ejects the ink from the nozzles.

The ink tanks 12A to 12D store the ink. Air layers 18A to 18D are formed on liquid surfaces of the ink in the ink tanks 12A to 12D. The ink tanks 12A to 12D form two ink tank pairs 20A and 20B for ink delivery. The ink tank pair 20A includes the ink tank 12A and the ink tank 12C. The ink tank pair 20B includes the ink tank 12B and the ink tank 12D.

The liquid level sensors 13A to 13D detect whether the liquid levels of the ink in the respective ink tanks 12A to 12D are equal to or higher than reference heights. There is hysteresis in a way the liquid level sensors 13A to 13D respond. Accordingly, the liquid level height at which the liquid level sensors 13A to 13D switch from off to on is different from the liquid level height at which the liquid level sensors 13A to 13D switch from on to off. Specifically, in the case where the liquid level is rising, the liquid level sensors 13A to 13D change from off to on when the liquid level reaches a first reference height. Meanwhile, in the case where the liquid level is falling, the liquid level sensors 13A to 13D changes from on to off when the liquid level falls to a second reference height below the first reference height.

The ink outflow route 14 is a flow passage of the ink flowing out from the ink tanks 12A to 12D toward the inkjet head 11. The ink outflow route 14 includes a main outflow pipe 21 and branching outflow pipes 22 to 24.

The main outflow pipe 21 forms the flow passage of the ink flowing out from the ink tank 12D toward the inkjet head 11. Moreover, the main outflow pipe 21 forms part of the flow passages of the ink flowing out from the ink tanks 12A to 12C toward the inkjet head 11. One end of the main outflow pipe 21 is connected to the inkjet head 11 and the other end of the main outflow pipe 21 is connected to the ink tank 12D.

The branching outflow pipes 22 to 24 form the flow passages of the ink flowing out from the ink tanks 12A to 12C to the main out flow pipe 21. One end of the branching outflow pipe 22 is connected to the main outflow pipe 21 and the other end of the branching outflow pipe 22 is connected to the ink tank 12A. One end of the branching outflow pipe 23 is connected to the main outflow pipe 21 and the other end of the branching outflow pipe 23 is connected to the ink tank 12B. One end of the branching outflow pipe 24 is connected to the main outflow pipe 21 and the other end of the branching outflow pipe 24 is connected to the ink tank 12C.

The ink outflow valves 15A to 15D allow and block outflow of the ink from the ink tanks 12A to 12D, respectively. The ink outflow valves 15A to 15C are arranged respectively in the branching outflow pipes 22 to 24. The ink outflow valve 15D is arranged in the main outflow pipe 21 between the ink tank 12D and a point where the main outflow pipe 21 and the branching outflow pipe 24 are connected to each other.

The ink inflow route 16 is a route of the ink flowing into the ink tanks 12A to 12D without being consumed in the inkjet head 11. The ink inflow route 16 includes a main inflow pipe 26 and branching inflow pipes 27 to 29.

The main inflow pipe 26 forms a flow passage of the ink from the inkjet head 11 to the ink tank 12D. Moreover, the main inflow pipe 26 forms part of flow passages of the ink from the inkjet head 11 to the ink tanks 12A to 12C. One end of the main inflow pipe 26 is connected to the inkjet head 11 and the other end of the main inflow pipe 26 is connected to the ink tank 12D.

The branching inflow pipes 27 to 29 form the flow passages of the ink flowing from the main inflow pipe 26 into the ink tanks 12A to 12C. One end of the branching inflow pipe 27 is connected to the main inflow pipe 26 and the other end of the branching inflow pipe 27 is connected to the ink tank 12A. One end of the branching inflow pipe 28 is connected to the main inflow pipe 26 and the other end of the branching inflow pipe 28 is connected to the ink tank 12B. One end of the branching inflow pipe 29 is connected to the main inflow pipe 26 and the other end of the branching inflow pipe 29 is connected to the ink tank 12C.

The ink inflow valves 17A to 17D allow and block inflow of the ink from the inkjet head 11 to the ink tanks 12A to 12D. The ink inflow valves 17A to 17C are arranged in the branching inflow pipes 27 to 29. The ink outflow valve 17D is arranged in the main inflow pipe 26 between the ink tank 12D and a point where the main inflow pipe 26 and the branching inflow pipe 29 are connected to each other.

The pressure generator 3 selectively generates positive pressure and negative pressure in each of the ink tanks 12A to 12D. The pressure generator 3 includes an air pump 31, a assure generation pipe 32, pressure generation adjustment pipes 33 and 34, connection pipes 35 and 36, pressure valves 37A to 37D, pressure adjustment valves 38 and 39, atmosphere open pipes 40A to 40D, atmosphere open valves 41A to 41D, and pressure sensors 42 and 43.

The air pump 31 moves air between one ink tank 12 and the other ink tank 12 in each ink tank pair 20. The air pump 31 is arranged in the pressure generation pipe 32 between a point where the pressure generation pipe 32 and the connection pipe 35 are connected to each other and a point where the pressure generation pipe 32 and the connection pipe 36 are connected to each other.

The pressure generation pipe 32 forms at least part of flow passages of air used to generate pressures for delivering the ink to the ink tanks 12A to 12D. One end of the pressure generation pipe 32 is connected to the air layer 18A of the ink tank 12A and the other end of the pressure generation pipe 32 is connected to the air layer 18C of the ink tank 12C.

The pressure generation adjustment pipes 33 and 34 form part of the flow passages of air used to generate the pressures for delivering the ink to the ink tanks 12B and 12D. Moreover, the pressure generation adjustment pipes 33 and 34 form flow passages of air used to adjust the pressures in the ink tanks 12A to 12D. One end of the pressure generation adjustment pipe 33 is connected to the air layer 18B of the ink tank 12B and the other end (atmosphere communication end) of the pressure generation adjustment pipe 33 communicates with the atmosphere. One end of the pressure generation adjustment pipe 34 is connected to the air layer 18D of the ink tank 12D and the other end (atmosphere communication end) of the pressure generation adjustment pipe 34 communicates with the atmosphere.

The connection pipes 35 and 36 connect the pressure generation adjustment pipes 33 axed 34 to the pressure generation pipe 32. The connection pipes 35 and 36 form part of the flow passages of air used to generate the pressures for delivering the ink to the ink tanks 12B and 12D.

The pressure valves 37A and 37C allow and block inflow of air from the pressure generation pipe 32 to the ink tanks 12A and 12C and also allow and block outflow of air from the ink tanks 12A and 12C to the pressure generation pipe 32. The pressure valve 37A is arranged in the pressure generation pipe 32 between the ink tank 12A and the point where the pressure generation pipe 32 and the connection pipe 35 are connected to each other. The pressure valve 37C is arranged in the pressure generation pipe 32 between the ink tank 12C and the point where the pressure generation pipe 32 and the connection pipe 36 are connected to each other.

The pressure valves 37B and 37D allow and block inflow of air from the pressure generation adjustment pipes 33 and 34 to the ink tanks 12B and 12D and also allow and block outflow of air from the ink tanks 12B and 12D to the pressure generation adjustment pipes 33 and 34. The pressure valve 37B is arranged in the pressure generation adjustment pipe 33 between the ink tank 12B and a point where the pressure generation adjustment pipe 33 and the connection pipe 35 are connected to each other. The pressure valve 37D is arranged in the pressure generation adjustment pipe 34 between the ink tank 12D and a point where the pressure generation adjustment pipe 34 and the connection pipe 36 are connected to each other.

The pressure adjustment valve 38 opens and closes a flow passage of air inside the pressure generation adjustment pipe 33 to adjust the pressures in the ink tanks 12A and 12B. The pressure adjustment valve 38 is arranged in the pressure generation adjustment pipe 33 between the atmosphere communication end and a point where the pressure generation adjustment pipe 33 and the connection pipe 35 are connected to each other.

The pressure adjustment valve 39 opens and closes a flow passage of air inside the pressure generation adjustment pipe 34 to adjust the pressures in the ink tanks 12C and 12D. The pressure adjustment valve 39 is arranged in the pressure generation adjustment pipe 34 between the atmosphere communication end and a point where the pressure generation adjustment pipe 34 and the connection pipe 36 are connected to each other.

The atmosphere open pipes 40A to 40D form flow passages of air for opening the ink tanks 12A to 12D to the atmosphere. One ends of the atmosphere open pipes 40A to 40D are connected respectively to the air layers 18A to 18D of the ink tanks 12A to 12D and other ends of the atmosphere open pipes 40A to 40D communicate with the atmosphere.

The atmosphere open valves 41A to 41D open and close the flow passages of air in the atmosphere open pipes 40A to 40D to switch the ink tanks 12A to 12D between a sealed state and an atmosphere open state.

The pressure sensor 42 detects the pressures in the ink tanks 12A and 12B. The pressure sensor 42 is connected to the connection pipe 35. The pressure sensor 43 detects the pressures in the ink tanks 12C and 12D. The pressure sensor 43 is connected to the connection pipe 36.

The ink supplier 4 supplies the ink to the ink tanks 12A to 12D. The ink supplier 4 includes an ink cartridge 46, an ink supply route 47, and ink supply valves 48A to 48D.

The ink cartridge 46 houses the ink used for printing by the inkjet head 11.

The ink supply route 47 is a route of the ink supplied from the ink cartridge 46 to the ink tanks 12A to 12D. The ink supply route 47 includes a common supply pipe 51 and branching supply pipes 52 to 55.

The common supply pipe 51 forms a common portion of a flow passage of the ink supplied to the ink tanks 12A to 12D. One end (upstream end) of the common supply pipe 51 is connected to the ink cartridge 46 and the other end (downstream end) of the common supply pipe 51 is connected to the branching supply pipes 52 and 55.

The branching supply pipe 52 forms a flow passage of the ink from the downstream find of the common supply pipe 51 to the ink tank 12A. The branching supply pipe 52 also forms part of flow passages of the ink from the downstream end of the common supply pipe 51 to the ink tanks 12B and 12C. One end of the branching supply pipe 52 is connected to the downstream end of the common supply pipe 51 and the other end of the branching supply pipe 52 is connected to the ink tank 12A.

The branching supply pipes 53 and 54 form flow passages of the ink supplied from the branching supply pipe 52 to the ink tanks 12B and 12C. One end of the branching supply pipe 53 is connected to the branching supply pipe 52 and the other end of the branching supply pipe 53 is connected to the ink tank 12B. One end of the branching supply pipe 54 is connected to the branching supply pipe 52 and the other end of the branching supply pipe 54 is connected to the ink tank 12C.

The branching supply pipe 55 forms a flow passage of the ink from the downstream end of the common supply pipe 51 to the ink tank 12D. One end of the branching supply pipe 55 is connected to the downstream end of the common supply pipe 51 and the other end of the branching supply pipe 55 is connected to the ink tank 12D.

The ink supply valves 48A to 48D allow and block inflow of the ink from the ink cartridge 46 to the ink tanks 12A to 12D. The ink supply valve 48A is arranged in the branching supply pipe 52 between the ink tank 12A and a point where the branching supply pipe 52 and the branching supply pipe 53 are connected to each other. The ink supply valves 48B to 48D are arranged respectively in the branching supply pipes 53 to 55.

The controller 5 controls operations of the units in the inkjet printer 1. The controller 5 includes a CPU, a RAM, a ROM, a hard disk drive, and the like.

In the printing, the controller 5 controls the pressure generator 3 such that the pressure generator 3 generates positive pressure and negative pressure for the ink delivery respectively in one ink tank 12 and another ink tank 12 in each of the ink tank pairs 20. The controller 5 thereby delivers the ink from the one ink tank 12 to the other ink tank 12 via the ink outflow route 14, the inkjet head 11, and the ink inflow route 16. Along with this operation, the controller 5 performs control such that the printing is performed by ejecting the ink from the inkjet head 11.

In the printing, the controller 5 alternately switches the ink tank pair 20 delivering the ink. Accordingly, the controller 5 performs a preparation process to be described later in one ink tank pair 20 while the other ink tank pair 20 is delivering the ink. Then, the controller 5 switches the ink tank pair 20 delivering the ink to the prepared ink tank pair 20. The controller 5 performs control such that this switching operation is repeated while printing is performed by ejecting the ink from the inkjet head 11.

Next, description is given of the preparation process for the ink delivery in the inkjet printer 1. The preparation process is a process of generating the pressures and supplying the ink in each of the ink tank pairs 20. Specifically, the preparation process is a process in which, in the ink tank pair 20, positive pressure and negative pressure are generated respectively in the one ink tank 12 and the other ink tank 12 by the pressure generator 3 and the ink is supplied by the ink supplier 4 depending on a remaining ink amount.

Figure 2:
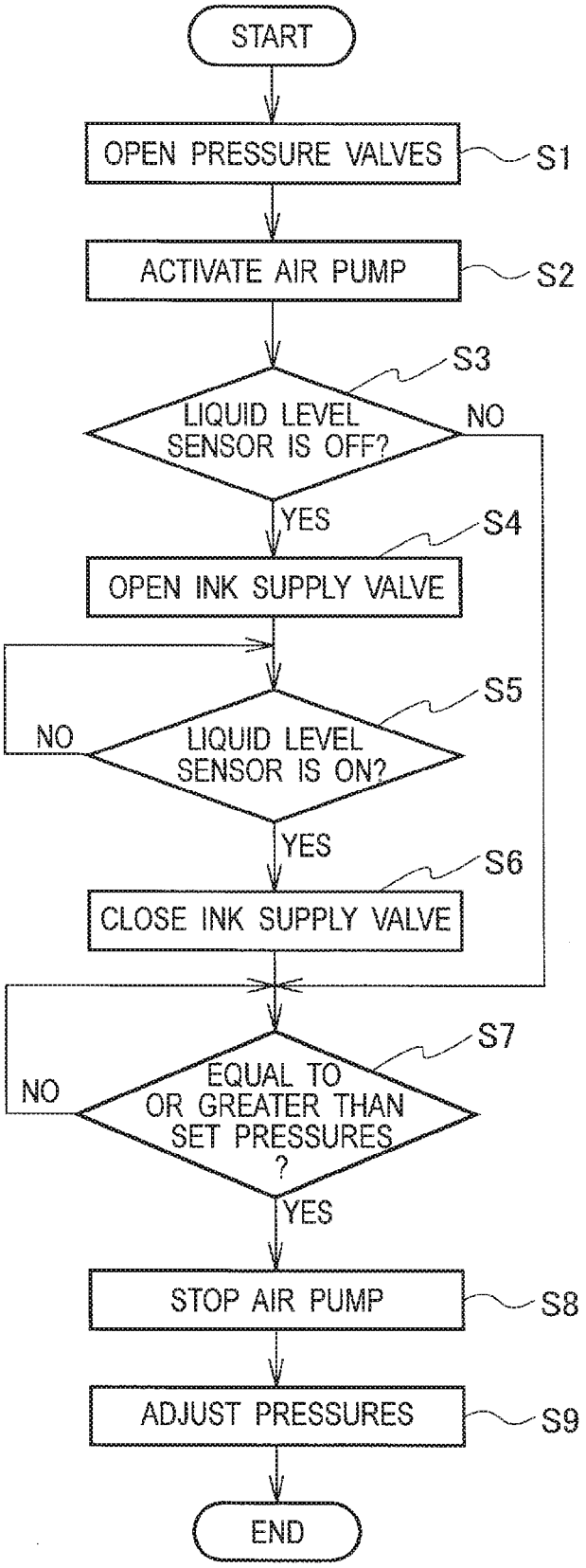
FIG. 2 is a flowchart of a preparation process in the inkjet printer illustrated in FIG. 1.
Figure 3:
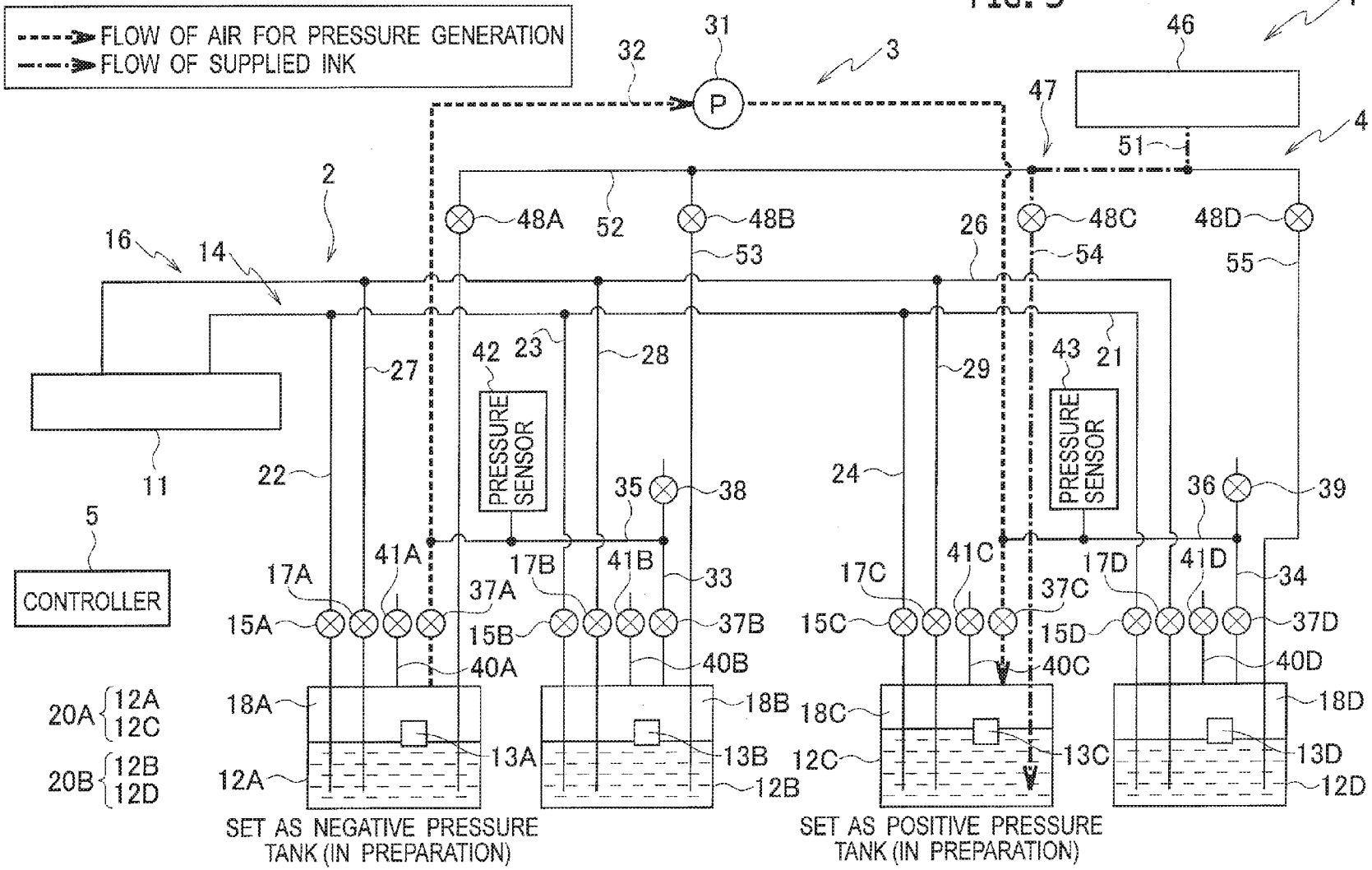
FIG. 3 is a view for explaining operations in the preparation process in the inkjet printer illustrated in FIG. 1.

FIG. 2 is a flowchart of the preparation process. FIG. 3 is a view for explaining operations in the preparation process. Here, description is given of an example of the preparation process in which negative pressure is generated in the ink tank 12A and positive pressure is generated in the ink tank 12C in the ink tank pair 20A. In other words, in this example, the ink tank 12A is set as a negative pressure tank and the ink tank 12C is set as a positive pressure tank.

In step S1 of FIG. 2, the controller 5 opens the pressure valves 37A and 37C. In this case, before the start of the preparation process, the pressure valves 37A and 37C are closed. Moreover, the pressure adjustment valves 38 and 39, the atmosphere open valves 41A and 41C, the ink supply valves 48A and 48C, the ink outflow valves 15A and 15C, and the ink inflow valves 17A and 17C are also closed.

Next, in step S2, the controller 5 activates the air pump 31. As illustrated in FIG. 3, air thereby starts to flow from the ink tank 12A to the ink tank 12C via the pressure generation pipe 32. This starts depressurization of the ink tank 12A and pressurization of the ink tank 12C.

Returning to FIG. 2, in step S3 subsequent to step S2, the controller 5 determines whether the liquid level sensor 13C of the ink tank 12C set as the positive pressure tank is off. When the controller 5 determines that the liquid level sensor 13C is on (step S3: NO), the controller 5 proceeds to step S7.

When the controller 5 determines that the liquid level sensor 13C is off (step S3: YES), in step S4, the controller 5 opens the ink supply valve 48C corresponding to the ink tank 12C. As illustrated in FIG. 3, the ink thereby starts to be supplied from the ink cartridge 46 to the ink tank 12C via the common supply pipe 51 and the branching supply pipes 52 and 54.

Returning to FIG. 2, in step S5 subsequent to step S4, the controller 5 determines whether the liquid level sensor 13C is on. When the controller 5 determines that the liquid level sensor 13C is not on (step S5: NO), the controller 5 repeats step S5.

When the controller 5 determines that the liquid level sensor 13C is on (step S5: YES), the controller 5 closes the ink supply valve 48C in step S6. The ink supply to the ink tank 12C is thereby completed. Thereafter, the controller 5 proceeds to step S7.

In step S7, the controller 5 determines whether the pressure (absolute value of negative pressure) in the ink tank 12A and the pressure (positive pressure) in the ink tank 12C are equal to or greater than set pressures, respectively, based on detection values of the pressure sensors 42 and 43. When the controller 5 determines that at least one of the pressure in the ink tank 12A and the pressure in the ink tank 12C is smaller than the corresponding set pressure (step S7: NO), the controller 5 repeats step S7.

When the controller 5 determines that the pressure in the ink tank 12A and the pressure in the ink tank 12C are equal to or greater than the respective set pressures (step S7: YES), in step S8, the controller 5 stops the air pump 31. The depressurization of the ink tank 12A and the pressurization of the ink tank 12C by the air pump 31 are thereby completed.

Next, in step S9, the controller 5 controls the pressure adjustment valves 38 and 39 to adjust the pressures in the ink tanks 12A and 12C to their respective set pressures. When the pressures in the ink tanks 12A and 12C are adjusted to their respective set pressures, the controller 5 closes the pressure valves 37A and 37C and the pressure adjustment valves 38 and 39.

The preparation process is thereby completed. When the preparation process is completed, the ink tank pair 20A is set to a state where negative pressure and positive pressure for the ink delivery are generated respectively in the ink tanks 12A and 12C and the ink is supplied to the ink tank 12C set as the positive pressure tank.

Next, operations in the printing of the inkjet printer 1 are described.

Figure 4:
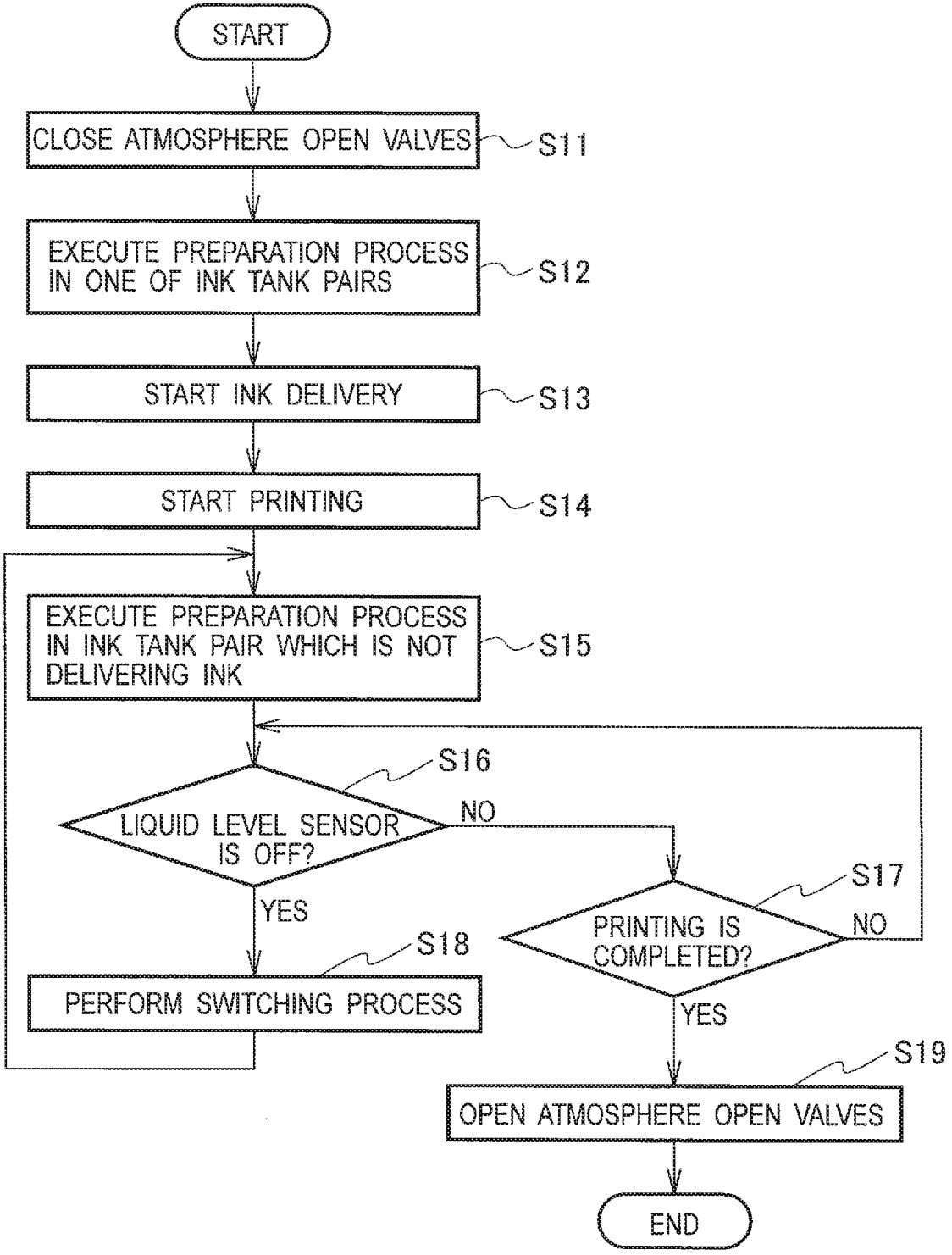
FIG. 4 is a flowchart for explaining operations in printing in the inkjet printer illustrated in FIG. 1.

FIG. 4 is a flowchart for explaining the operations in the printing of the inkjet printer 1. FIGS. 5 to 8 are views for explaining the operations in the printing.

A process of the flowchart of FIG. 4 starts when a print job is inputted to the inkjet printer 1.

In step S11 of FIG. 4, the controller 5 closes the atmosphere open valves 41A to 41D.

In the inkjet printer 1 in a standby state before the input of the print job, the atmosphere open valves 41A to 41D are opened and the ink tanks 12A to 12D are thus set to a state open to the atmosphere. Moreover, in the ink tank pair 20 delivering the ink at the end of the previous printing, the ink outflow valve 15 corresponding to the ink tank 12 set as the positive pressure tank at the end of the previous prig ting and the ink inflow valve 17 corresponding to the ink tank 12 set as the negative pressure tank at the end of the previous printing are opened. The other ink outflow Valve 15, the other ink inflow valve 17, the pressure valves 37A to 37D, the pressure adjustment valves 38 and 39, and the ink supply valves 48A to 48D are closed.

Next, in step S12, the controller 5 executes the aforementioned preparation process in one of the ink tank airs 20. Specifically, the controller executes the preparation process in the ink tank pair 20 different from the ink tank pair 20 delivering the ink at the end of the previous printing.

Next, in step S13, the controller 5 starts the ink delivery in the ink tank pair 20 for which the preparation process is performed in step S12. Specifically, the controller 5 opens the ink outflow valve 15 corresponding to the ink tank 12 set as the positive pressure tank in the ink tank pair 20 for which the preparation process is performed in step S12 and the ink inflow valve 17 corresponding to the ink tank 12 set as the negative pressure tank in this ink tank pair 20. Along with this operation, in the ink tank pair 20 delivering the ink at the end of the previous printing, the controller 5 closes the ink outflow valve 15 corresponding to the ink tank 12 set as the positive pressure tank at the end of the previous printing and the ink inflow valve 17 corresponding to the ink tank 12 set as the negative pressure tank at the end of the previous printing.

For example, assume that, at the end of the previous printing, the ink tank pair 20B delivers the ink, the ink tank 12B is set as the positive pressure tank, and the ink tank 12D s set as the negative pressure tank. Then, assume that, in step S12 of FIG. 4, the preparation process is performed in the ink tank pair 20A as described above by using FIG. 3.

In this case, in order to start the ink delivery in the ink tank pair 20A, the controller 5 opens the ink inflow valve 17A corresponding to the ink tank 12A in the ink tank pair 20A and the ink outflow valve 15C corresponding to the ink tank 12C in the ink tank pair 20A. Along with this operation, the controller 5 closes the ink outflow valve 15B corresponding to the ink tank 12B in the ink tank pair 20B and the ink inflow valve 17D corresponding to the ink tank 12D in the ink tank pair 20B.

Figure 5:
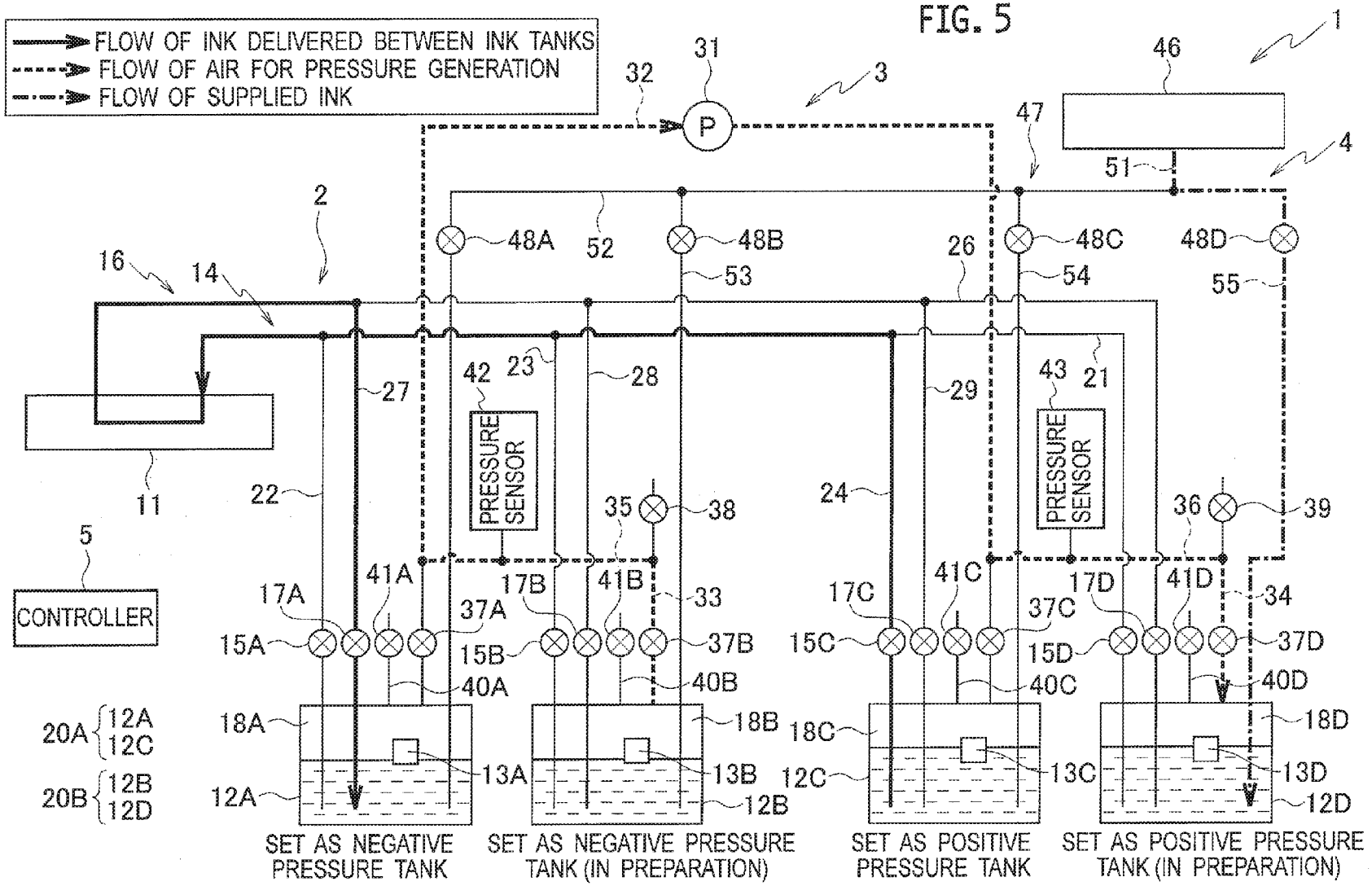
FIG. 5 is a view for explaining the operation in the printing in the inkjet printer illustrated in FIG. 1.

As illustrated in FIG. 5, the ink thereby flows out from the ink tank 12C into the ink tank 12A via the ranching outflow pipe 24, the main outflow pipe 21, the inkjet head 11, the main inflow pipe 26, and the branching inflow pipe 27.

Returning to FIG. 4, in step S14 subsequent to step S13, the controller 5 controls the inkjet head 11, to start printing based on the print job. Part of the ink supplied to the inkjet head 11 from the ink tank 12 set as the positive pressure tank in the ink tank pair 20 which is delivering the ink is thereby ejected and the remaining ink flows to the ink tank 12 set as the negative pressure tank. For example, when the ink is being delivered as in FIG. 5, part of the ink supplied from the ink tank 12C to the inkjet head 11 is ejected and the remaining ink flows to the ink tank 12A.

Next, in step S15, the controller 5 executes the preparation process in the ink tank pair 20 which is not delivering the ink. For example, as illustrated in FIG. 5, while the ink is being delivered in the ink tank pair 20A, the controller 5 executes the preparation process in the ink tank pair 20B. The ink tank pair 20B is thereby set to a state where negative pressure and positive pressure for the ink delivery are generated respectively in the ink tanks 12B and 12D and the ink is supplied to the ink tank 12D set as the positive pressure tank. In this case, as illustrated in FIG. 5, in the preparation process in the ink tank pair 20B, the drive of the air pump 31 causes air to flow between the ink tanks 12B and 12D via the pressure generation adjustment pipe 33, the connection pipe 35, the pressure generation pipe 32, the connection pipe 36, and the pressure generation adjustment pipe 34.

Next, in step S16, the controller 5 determines whether the liquid level sensor 13 of the ink tank 12 set as the positive pressure tank in the ink tank pair 20 which is delivering the ink is off.

In this case, regarding the ink tank pair 20 which is delivering the ink, the liquid level sensor 13 of the ink tank 12 set as the positive pressure tank is on at the time point where the preparation process is completed for this ink tank pair 20. When the outflow of the ink from the ink tank 12 set as the positive pressure tank due to the ink delivery causes the liquid level height to fall to the aforementioned second reference height, the liquid level sensor 13 changes from on to off.

When the controller 5 determines that the liquid level sensor 13 of the ink tank 12 set as the positive pressure tank in the ink tank pair 20 which is delivering the ink is on (step S16: NO), in step S17, the controller 5 determines whether the printing based on the print job is completed. When the controller 5 determines that the printing is not completed (step S17: NO), the controller 5 returns to step S16.

In step S16, when the controller 5 determines that the fluid level sensor 13 of the ink tank 12 set as the positive pressure tank in the ink tank pair 20 which is delivering the ink is off (step S16: YES), in step S18, the controller 5 performs a switching process of the ink tank pair 20. The switching process of the ink tank pair 20 is a process for switching the ink tank pair 20 delivering the ink.

Specifically, the controller 5 closes the ink outflow valve 15 corresponding to the ink tank 12 set as the positive pressure tank in the ink tank pair 20 which is delivering the ink and the ink inflow valve 17 corresponding to the ink tank 12 set as the negative pressure tank in this ink tank pair 20. Along with this operation, the controller 5 opens the ink outflow valve 15 corresponding to the ink tank 12 set as the positive pressure tank in the ink tank pair 20 for which the preparation process is performed in step S15 and the ink inflow valve 17 corresponding to the ink tank 12 set as the negative pressure tank in this ink tank pair 20. The ink tank pair 20 delivering the ink is thereby switched. Thereafter, the controller 5 returns to step S15 and performs the preparation process. In this case, the controller 5 performs the preparation process with the positive pressure tank setting and the negative pressure tank setting of the respective ink tanks 12 being switched from those in the previous ink delivery.

Figure 6:
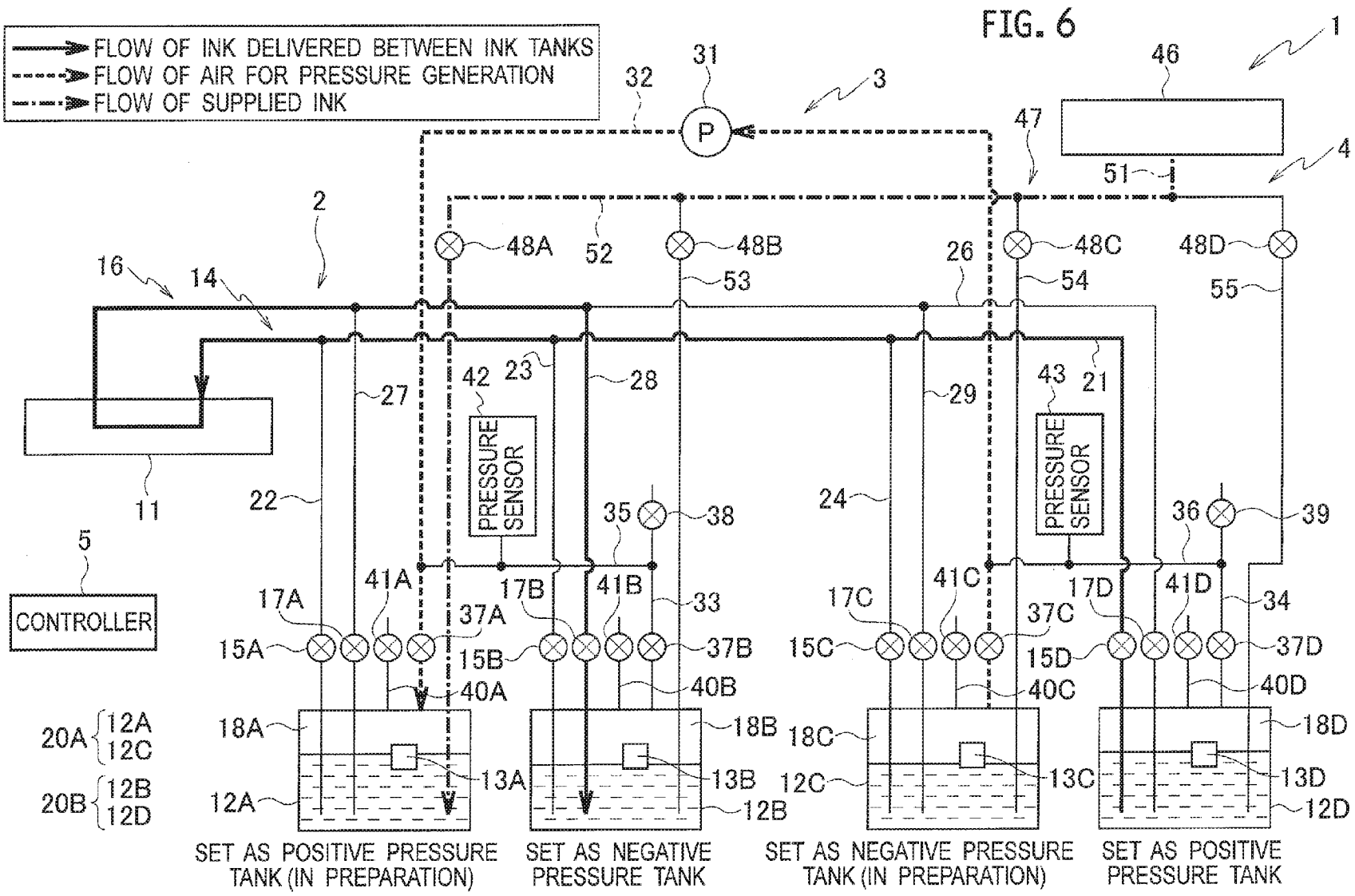
FIG. 6 is a view for explaining the operation in the printing in the inkjet printer illustrated in FIG. 1.

For example, when the liquid level sensor 13C of the ink tank 12C switches off during the ink delivery in the ink tank pair 20A as in FIG. 5, the controller 5 closes the ink outflow valve 15C and the ink inflow valve 17A. Along with this operation, the controller 5 opens the ink outflow valve 15D of the ink tank 12D in the prepared ink tank pair 20B and the ink inflow valve 17B of the ink tank 12B in the ink tank pair 20B. As illustrated in FIG. 6, the ink delivery in the ink tank pair 20B is thereby started. Moreover, the controller 5 performs the preparation process in the ink tank pair 20A with the ink tank 12A set as the positive pressure tank and the ink tank 12C set as the negative pressure tank.

Steps S15 to S18 are repeated until the printing is completed. The printing by the inkjet head 11 is thereby performed while the ink tank pair 20 delivering the ink is switched.

Figure 7:
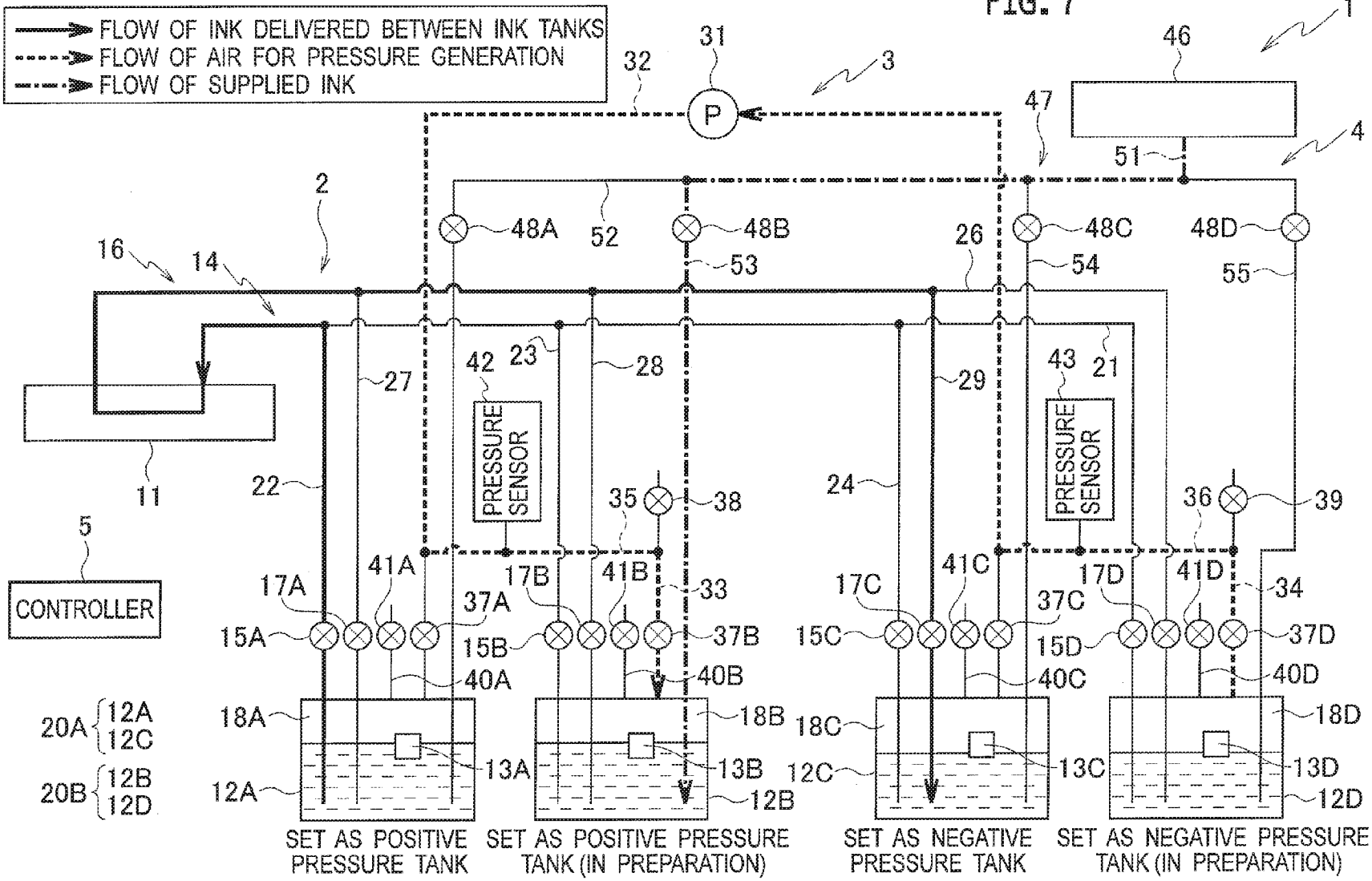
FIG. 7 is a view for explaining the operation in the printing in the inkjet printer illustrated in FIG. 1.
Figure 8:
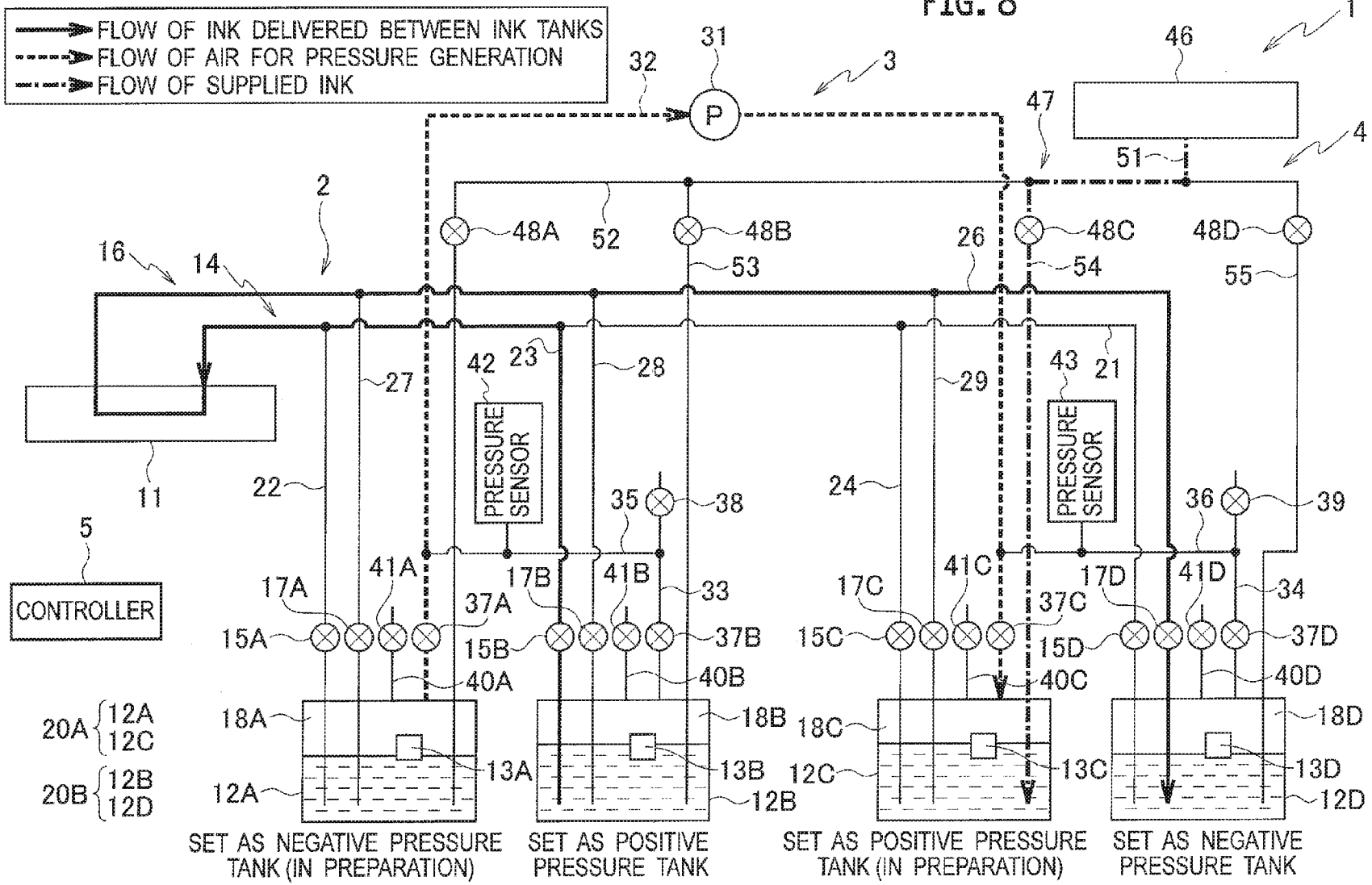
FIG. 8 is a view for explaining the operation in the printing in the inkjet printer illustrated in FIG. 1.

For example, when the liquid level sensor 13D of the ink tank 12D switches off during the ink delivery in the ink tank pair 20B as in FIG. 6, the ink delivery switches to that in the ink tank pair 20A as in FIG. 7. When the liquid level sensor 13A of the ink tank 12A switches off during the ink delivery in the ink tank pair 20A as in FIG. 7, the ink delivery switches to that in the ink tank pair 20B as in FIG. 8. When the liquid level sensor 13B of the ink tank 12B switches off during the ink delivery in the ink tank pair 20B as in FIG. 8, the ink delivery switches to that in the ink tank pair 20A as in FIG. 5. As described above, the printing by the inkjet head 11 is performed while the ink tank pair 20 delivering the ink is switched as in changes from FIG. 5 to FIG. 6, to FIG. 7, to FIG. 8, to FIG. 5, and so on.

In step S17, when the controller 5 determines that the printing is completed (step S17: YES), in step S19, the controller 5 opens the atmosphere open valves 41A to 41D. The ink tanks 12A to 12D are thereby opened to the atmosphere and the ink delivery in the ink tank pair 20 delivering the ink is completed. The series of operations is thereby completed.

As described above, the inkjet printer 1 includes the two ink tank pairs 20A and 20B. The controller 5 performs the preparation process in one ink tank pair 20 while the ink is being delivered in the other ink tank pair 20. Then, the controller 5 switches the ink tank pair 20 delivering the ink to the prepared ink tank pair 20. The controller 5 performs control such that this operation is repeated while the printing is performed by ejecting the ink from the inkjet head 11.

The inkjet printer 1 can thereby perform printing while continuously delivering the ink to the inkjet head 11 in a configuration using no ink pump for delivering the ink between the ink tanks. Accordingly, for example, when ink including pigment is used, it is possible to avoid problems such as failures of parts of the ink pump due to wear of the parts caused by the ink. Hence, the restriction on types of usable inks can be relaxed in the inkjet printer 1.

Moreover, since no ink pump is used in the inkjet printer 1, it is possible to eliminate nozzle pressure fluctuation caused by pulsation of the ink pump. This can reduce a deterioration in print quality due to variation in ink ejection amount which is caused by the nozzle pressure fluctuation.

Furthermore, the inkjet printer 1 performs no ink supplying or pressure generation in the ink tank pair 20 which is delivering the ink. Accordingly, during the printing, the nozzle pressure does not fluctuate due to liquid level fluctuation in the ink tanks 12 which occurs in the ink supplying or due to pressure fluctuation in the ink tanks 12 which occurs in the pressure generation. This can reduce the deterioration in print quality due to variation in ink ejection amount which is caused by the nozzle pressure fluctuation.

Note that, when the capacity of each ink tank is sufficiently large, pressure fluctuation can be absorbed. Accordingly, in this case, it is possible to perform at least one of the ink supplying and the pressure generation in the ink tank pair which is delivering the ink.

Moreover, although the configuration including the two ink tank pairs is described in the embodiment described above, the present invention can be also applied to a configuration including three or more ink tank pairs. When there are three or more ink tank pairs, control is performed such that the preparation process is performed in the ink tank pairs other than the ink tank pair which is delivering the ink, and the ink tank pair delivering the ink is sequentially switched to the prepared ink tank pairs.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

an inkjet head configured to eject ink;

a first ink tank pair being a pair of a first ink tank and a second ink tank each configured to store the ink;

a second ink tank pair being a pair of a third ink tank and a fourth ink tank each configured to store the ink;

an ink flow passage connecting the inkjet head with the first to fourth ink tanks and not including a pump through which the ink flows;

a pressure generator configured to selectively generate positive pressure and negative pressure in the first to fourth ink tanks;

an ink supplier configured to supply the ink to the first to fourth ink tanks;

an ink supply flow passage connecting the ink supplier with the first to fourth ink tanks and not including a pump through which ink flows, and a controller configured to control the inkjet head, the pressure generator, and the ink supplier, wherein the controller is configured to:

drive the pressure generator to generate positive pressure and negative pressure for ink delivery respectively in the first ink tank and the second ink tank of the first ink tank pair and perform printing by ejecting the ink from the inkjet head while delivering the ink between the first ink tank and the second ink tank of the first ink tank pair via the ink flow passage and the inkjet head;

during the ink delivery in the first ink tank pair, as a preparation for ink delivery in the second ink tank pair, drive the pressure generator to generate positive pressure and negative pressure respectively in the third ink tank and the fourth ink tank of the second ink tank pair and drive the ink supplier to supply the ink to the second ink tank pair; and upon completion of the ink delivery in the first ink tank pair, perform printing by ejecting the ink from the inkjet head while delivering the ink between the third ink tank and the fourth ink tank of the second ink tank pair prepared for the ink delivery via the ink flow passage and the inkjet head.

2. The inkjet printer according to claim 1, wherein the controller is configured to:

during the ink delivery in the second ink tank pair, as a preparation of ink delivery in the first ink tank pair, drive the pressure generator to generate positive pressure and negative pressure respectively in the first ink tank and the second ink tank of the first ink tank pair and drive the ink supplier to supply the ink to the first ink tank pair; and upon completion of the ink delivery in the second ink tank pair, perform printing by ejecting the ink from the inkjet head while delivering the ink between the first ink tank and the second ink tank of the first ink tank pair prepared for the ink delivery via the ink flow passage and the inkjet head.

3. The inkjet printer according to claim 1, wherein each ink tank includes an ink input pipe, an ink output pipe, an air supply pipe and a pipe openable to atmosphere.

4. The inkjet printer according to claim 1, wherein a nozzle pressure of the inkjet head is independent of liquid level fluctuations of the ink in the ink tanks.

5. The inkjet printer according to claim 1, wherein each of the ink tanks includes a liquid level sensor that detects whether the liquid level of the ink in the ink tank is equal to or higher than a predetermined level.

6. The inkjet printer according to claim 1, wherein the pressure generator comprises an air pump that is connected to move air between each ink tank of each ink tank pair.

7. The inkjet printer according to claim 6, wherein the pressure generator further includes an adjustment pipe connected, at one end, to the air of one of the ink tanks of each ink tank pair and an other end of the adjustment pipe is openable to the atmosphere.

8. The inkjet printer according to claim 6, wherein the pressure generator further includes a pressure sensor that detects the air pressure in each ink tank of each ink tank pair.

9. The inkjet printer according to claim 1, wherein the controller includes a CPU, RAM, ROM and a hard disk drive.

10. The inkjet printer according to claim 1, wherein the ink supplier comprises an ink cartridge that supplies ink to each of the ink tanks of each ink tank pair.

* * * * *